United States Patent [19]

Kita

[11] 3,943,826

[45] Mar. 16, 1976

[54] HYDRAULIC MOTORS AND PUMPS

[75] Inventor: Yasuo Kita, Kyoto, Japan

[73] Assignee: Shimadzu Seisakusho, Ltd., Kyoto, Japan

[22] Filed: May 23, 1975

[21] Appl. No.: 580,212

Related U.S. Application Data

[63] Continuation of Ser. No. 420,944, Dec. 30, 1973, which is a continuation of Ser. No. 212,291, Dec. 27, 1971, abandoned.

[30] Foreign Application Priority Data

Dec. 30, 1970 Japan ..... 45-127708

[52] U.S. Cl. ..... 91/488; 91/491; 91/494

[51] Int. Cl.[2] ..... F01B 1/06

[58] Field of Search ..... 91/478, 481, 488, 491, 91/493, 495, 498; 92/72

[56] References Cited

UNITED STATES PATENTS

| | | | |
|---|---|---|---|
| 1,710,567 | 4/1929 | Carey | 91/503 |
| 1,843,338 | 2/1932 | Replogle | 91/495 |
| 3,199,460 | 8/1965 | Bush et al. | 91/494 |
| 3,777,624 | 12/1973 | Dixon | 91/488 |

*Primary Examiner*—William L. Freeh
*Assistant Examiner*—G. P. LaPointe
*Attorney, Agent, or Firm*—Morgan, Finnegan, Pine, Foley & Lee

[57] ABSTRACT

In a hydraulic motor or pump comprising a casing, a shaft, means journalling said shaft in said casing, an eccentric on said shaft, a bearing block within said casing and about said eccentric and having a bore permitting relative rotation between said bearing block and said eccentric, a plurality of hydraulic cylinders formed and grouped in said bearing block radially about said eccentric in a common plane normal to the axis of said shaft, a plunger slidable in each of said cylinders, said plunger having an outer end face, flat faces of abutments formed in said casing at its internal surface for engagement with said outer end faces of said plungers, respectively, means urging said plunger in the direction of said face abutment of said casing during the operation of said motor or pump, and said bearing block having a port communicating between its bore and the interior of each of said cylinder interior, whereby pressure liquid is admitted to the cylinders in turn one after another during the operation of said motor or pump, an improvement in hydrostatic pressure supporting means for keeping said plunger in balance comprises a centrally disposed recess formed in said outer end surface of said plunger in alignment with the axis of said plunger and a port formed in said plunger communicating said recess with said cylinder interior.

7 Claims, 9 Drawing Figures

Fig. 2.
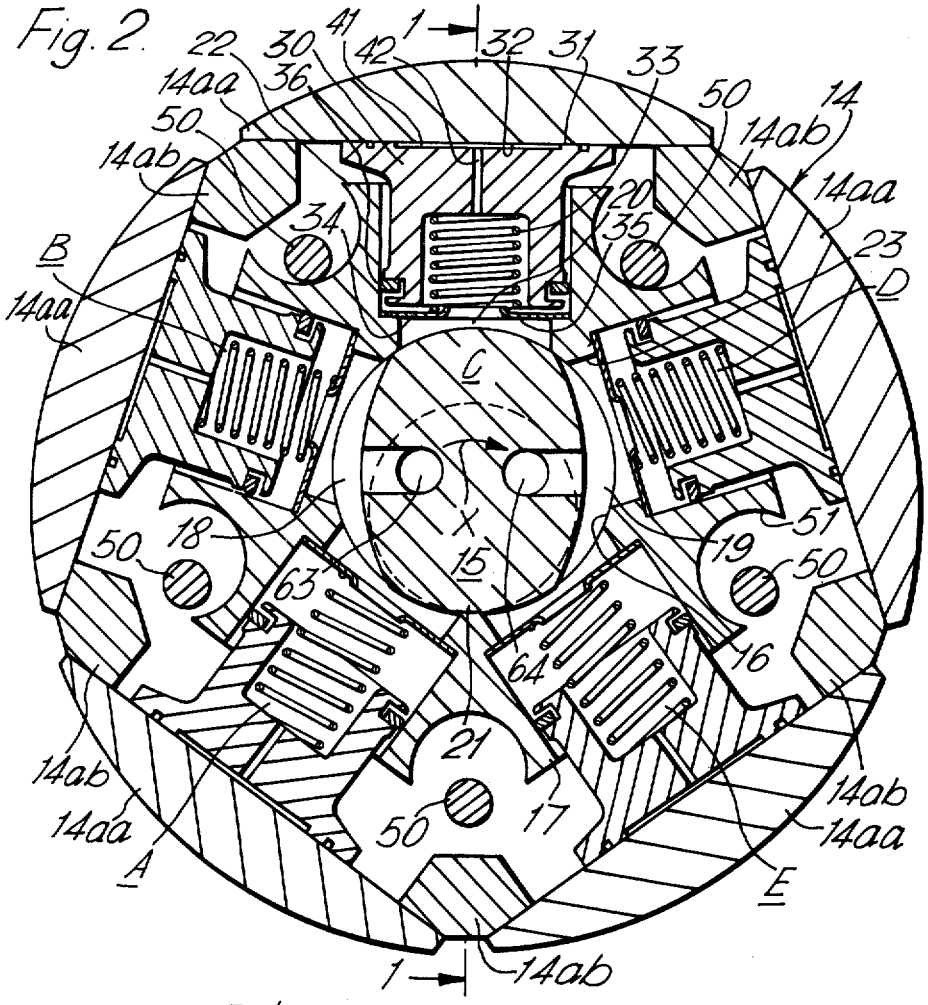
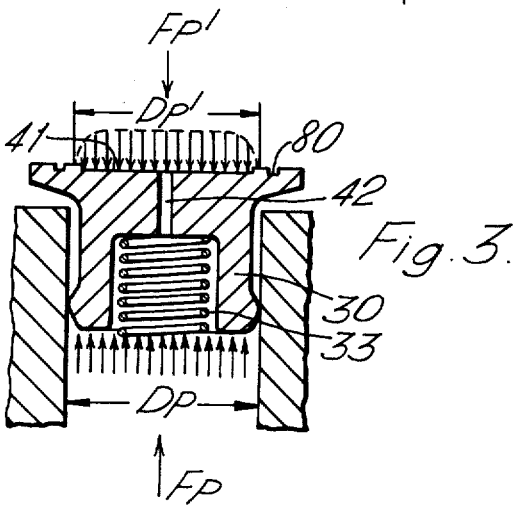
Fig. 3.

L2
L2
P2
P3
P4
P1
CB
P5
S
C 32
30
17

81
82
16
15
11

HYDRAULIC MOTORS AND PUMPS

This is a continuation, of application Ser. No. 420,944 filed Dec. 30, 1973, which is a continuation of application Ser. No. 212,291 filed Dec. 27, 1971 and now abandoned.

BACKGROUND OF THE INVENTION

This invention relates to hydraulic motors and pumps. For convenience of description however, reference is hereinafter made mainly to hydraulic motors.

Hydraulic motors are known comprising a casing having a plurality of hydraulic cylinders radially grouped about a floating bearing block, and a shaft journalled in said casing having an eccentric working in a cylindrical bore of the bearing block, the hydraulic cylinders being arranged to transmit liquid pressure to the bearing block imparting to it a circular motion with resultant rotation of either the eccentric with the motor shaft or rotation of the motor casing and hydraulic cylinders the shaft remaining stationary.

Generally, this type of hydraulic motor suffer two types of energy losses, namely mechanical friction loss and leakage loss of high pressure liquid, which decrease efficiency. Mechanical friction, mainly, sliding friction results in shortening the useful life of parts. Leakage of pressure liquid will cause a temperature elevation of the pressure liquid when it is recirculated for use. The temperature elevation of the working liquid will then cause a decrease in the viscosity of the liquid with the result of a further leakage.

If it is possible to apply hydrostatic bearing means to the sliding surfaces of the main parts of a hydraulic motor to keep each main part in a substantially perfect hydrostatic balance, this would result in a great decrease in the friction loss at mechanical pressure contact sliding parts and would also make it possible to decrease the leakage loss to the minimum. Thus, this solution of the problem is very effective to improve performance and obtain a hydraulic motor of highest efficiency adapted for high pressure running.

Attempts have been made to utilize hydraulic static bearing means between the plunger and the bearing block or between the plunger and the casing of hydraulic motors or pumps of the type described. For example, the hydraulic motor disclosed in U.S. Pat. No. 3,036,557 comprises a casing, a shaft, means journalling said shaft in said casing, an eccentric on said shaft, a bearing block within said casing and about said eccentric and having a bore permitting relative rotation between said bearing block and said eccentric, a plurality of hydraulic cylinders grouped radially about the axis of said shaft in a common plane normal to said axis, said cylinders being located in one of the members of the two comprising said casing and said bearing block, a hollow plunger in each cylinder and displaceable therein, resilient means urging said plunger in the direction of the other of said members, a pressure-retaining ring at the interface between said plunger and said other of said two members, said ring and the plunger end adjacent to said ring having openings in continuity with one another and with the plunger interior, and said bearing block having a port communicating between its bore and the volume defined by said plunger interior and said openings, whereby pressure liquid admitted to the cylinders in turn one after another during the operation of the motor exert direct thrust on the eccentric without the intermediary of mechanical means. The pressure retaining ring allows the pressure liquid to act over an area within the ring thus keeping the bearing block in balance and also provides for any misalignment between the surface of the bearing block and the inner end of the plunger.

In the hydraulic motor disclosed in the above mentioned U.S. patent, the pressure chamber for a hydrostatic bearing is formed either in the bearing block or in the interior surface of the casing. Since there is a relative sliding movement between the top or bottom end surface of the plunger and the cooperating interior surface of said casing or the cooperating surface of the bearing block, the pressure chamber for a hydrostatic bearing formed in the casing or the bearing block cannot be kept in alignment with the axis of the plunger. This produces a lateral moment which must be supported by the wall of the cylinder. Any pressure on the wall of the cylinder increases the friction between the plunger and the cylinder. On the other hand, in order to support by the cylinder the moment acting on the plunger the contact length of the plunger with the cylinder must be relatively long. A long contact length of the plunger is disadvantageous in that the sealing engagement between the top or bottom surface of the plunger and the cooperating surface of the casing or the bearing block is ready to be lost because any lateral movement of the plunger with respect to the cylinder is completely constrained by the cylinder.

On the other hand, recently there has been eager demand for a hydraulic motor which has superior performance in connection with starting and very-low speed operation, or presents a minimum difference between starting torque and running torque and which ensures smooth rotation without casing slip stick.

With the above in mind, the present invention is intended to provide a hydraulic motor or pump wherein the loaded sliding surfaces of the main parts are arranged to support loads in a hydrostatic bearing fashion to minimize contact surface pressure due to mechanical (solid-to-solid) contact between parts on loaded sliding surfaces, and friction loss to loaded sliding surfaces and particularly adverse effects due to coulombs friction are minimized and wear is also minimized, so that the motor or pump has a long life and is adapted for use at high pressures.

Another object of the invention is to provide a hydraulic motor or pump whose external dimensions are small as compared with its effective displacement (volume displaced).

A further object of the invention is to provide a hydraulic motor whose rotating parts have a small amount of moment of inertia as compared with the torque generated.

A still further object of the invention is to provide a hydraulic motor whose compressive volume is small as compared with the displacement.

An additional object of the invention is to provide a hydraulic motor or pump which is relatively small in the number of components, easy to manufacture and inexpensive.

Yet another object of the invention is to provide improvements in hydraulic motors and pumps thereby to simplify their construction and increase their efficiency.

SUMMARY OF THE INVENTION

With the attainment of the above mentioned object in view, the invention provides an improved hyraulic motor or pump in which the pressure of the liquid admitted to the cylinders in turn one after another during the operation is made to exert direct thrust on the eccentric. The hydraulic motor or pump according to the invention includes a casing, a shaft, means journalling said shaft in said casing, an eccentric on said shaft, a bearing block within said casing and about said eccentric and having a bore permitting relative rotation between said bearing block and said eccentric, a plurality of hydraulic cylinders formed and grouped in said bearing block radially about said eccentric in a common plane normal to the axis of said shaft, a plunger axially slidable in each of said cylinders, said plunger having an outer end surface, flat faces of abutments formed in said casing at its internal surface for engagement with said outer end surfaces of said plungers, respectively, means urging said plunger in the direction of said face of abutment of said casing during the operation of said motor or pump, and said bearing block having a port communicating between its bore and said cylinder interior, whereby pressure liquid admitted to the cylinders in turn one after another during the operation of said motor or pump exerts direct thrust on the eccentric. The hydraulic motor or pump according to the invention further includes an improved hydrostatic pressure supporting means for keeping each of the plungers in pressure balance. The improved hydrostatic pressure supporting means comprises a centrally disposed recess formed in said outer end face of said plunger alignment with the axis of the plunger and a port formed in each of said plungers communicating said recess with said cylinder interior. The effective area of said recess in said outer end face of said plunger is large enough to keep said plunger in pressure balance in the direction of the axis of said plunger. The piston may be only engageable at its limited length with the interior wall of said cylinder. The limited length of the engageable portion of said plunger may be less than one tenth of the diameter of said plunger.

In the above mentioned hydraulic motor or pump according to the invention, at least one high pressure liquid column is radially formed on one side of the eccentric of the shaft, the hydraulic pressure serving to directly produce a shaft turning moment, and moreover, the bearing block and plungers are maintained in substantially perfect hydrostatic balance. The contact between the plunger and the cylinder in which it is fitted may be nearly line contact thereby giving some freedom to the plunger with respect to the bearing block, thereby securing close contact between the outer end face of each plunger and the inner surface of the casing.

The casing of the motor or pump is preferably provided with a drain through which leakage liquid in the interior of said casing may be discharged to a tank outside of said casing and through which occassionally a liquid pressure may be supplied to the interior of said casing for an idle operation of said motor or pump.

In a modified embodiment of the invention the outer peripheral surface of the eccentric is formed in a cone. The cooperating bearing block has, accordingly, a conical central bore engageable with the conical outer peripheral surface of the eccentric for a relative rotation therebetween. The flat faces of abutments formed in the casing are also extending in planes parallel to the generatrix of the conical outer peripheral surface of the eccentric. With this arrangement, the degree of fitting between the eccentric and the bearing block can be improved, which, in turn, facilitates the machining of the eccentric and the central bore of the bearing block.

BRIEF DESCRIPTION OF THE DRAWINGS

By way of example some constructional forms of hydraulic motors incorporating the foregoing and other features of the invention are illustrated on the accompanying drawings.

FIG. 2 is a cross section taken along the lines 2—2 of FIG. 1;

FIG. 3 shows an illustration of the pressure balance on a plunger of a motor illustrated in FIGS. 1 and 2;

DETAILED DESCRIPTION OF THE PREFERRED EMBODIMENT

The invention will be described with reference to embodiments thereof. Although the apparatus may be used as a pump, it will be described below as a hydraulic motor.

Figure 1:
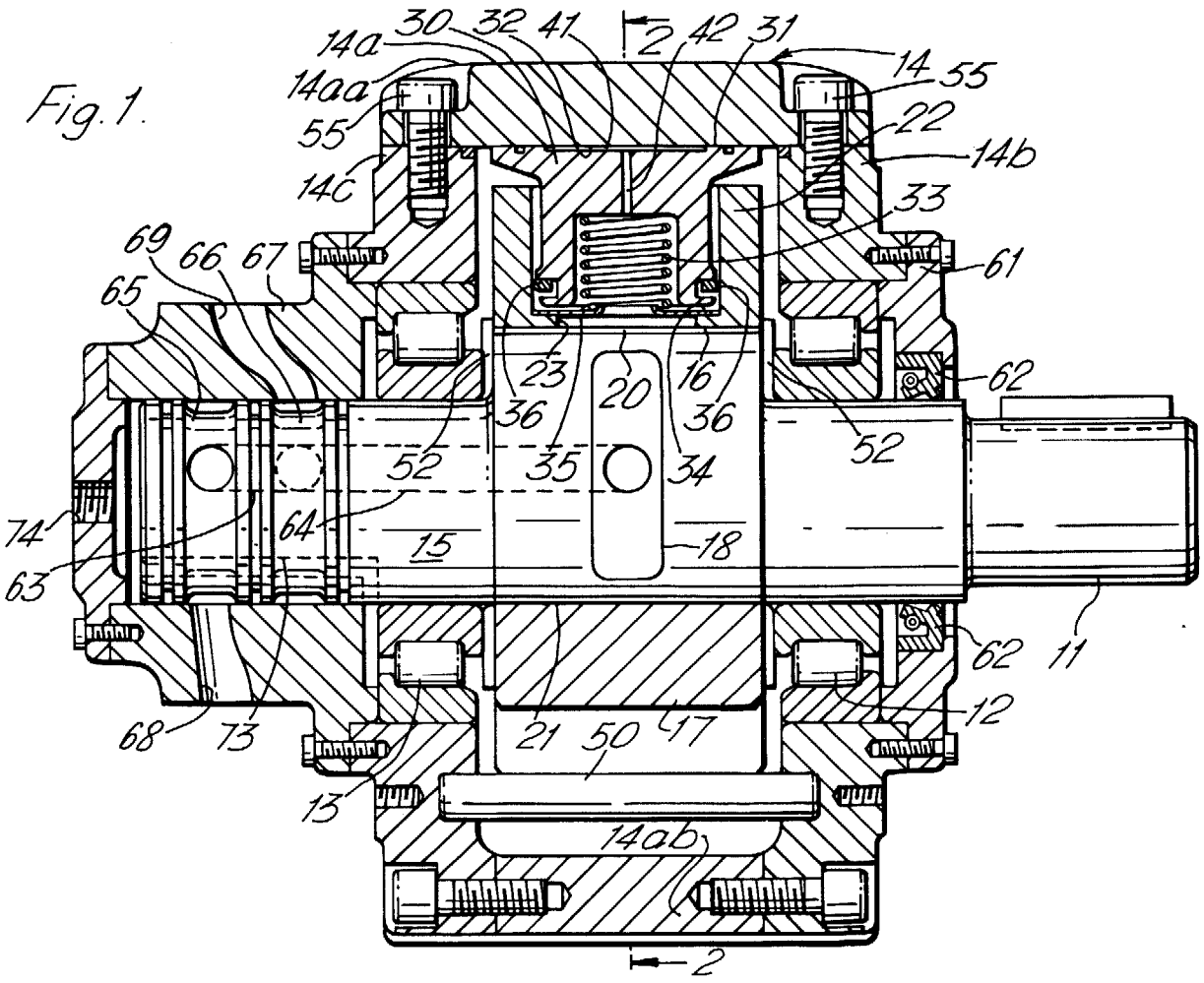
FIG. 1 is an axial section, taken along the lines of 1—1 of FIG. 2, of a motor embodying the invention.

In the hydraulic motor illustrated in FIGS. 1 and 2, a motor shaft 11 is supported for rotation by a pair of roller bearings 12, 13 which are then carried by a casing 14. The casing 14 comprises a side wall body 14 (*a*), a front end cover 14 (*b*) and a rear end cover 14 (*c*). The front and rear end cover 14 (*b*) and 14 (*c*) carry the roller bearings 12 and 13, respectively.

The shaft 11 has an eccentric 15 between the two bearings 12 and 13. The eccentric 15 is arranged to rotate in the cylindrical bore 16 of a bearing block 17 having substantially the form of a pentagon in end view. The center of the bearing block 17 is coincident with the axis of eccentricity of the eccentric 15. The periphery of the eccentric 15 of the motor shaft 11 is formed with two oppositely situated arcuate grooves 18 and 19 separated from one another at both ends by lands 20 and 21 constituting in effect valve means as described hereinbelow.

The cylinder block 17 is rotatably fitted on the eccentric 15 with a narrow clearance therebetween and is formed with an odd number of radial cylinders 22. In the embodiment illustrated in FIGS. 1 and 2, five cylinders are shown. Each cylinder has an outer end opening and a radial port 23 communicating the interior of the cylinder 22 with the cylindrical bore 16. The radial ports 23 are covered and uncovered by the aforesaid arcuate grooves 18 and 19 and lands 20 and 21 of the eccentric 15 as the eccentric and the motor shaft rotate.

A hollow plunger 30 is slidable in each hydraulic cylinder 22 and has its outer end face 31 which is usually kept in sealing contact with the interior surface of the casing 14. The casing 14 is formed at the interior surface of its side wall body 14*a* with flat faces 32 of abutments which are oppositely disposed to the respective cylinders 23. The outer end face 31 of the plunger 30 is in sealing contact with the flat face 32 in the interior wall of the body 14*a*. The plunger 30 is always urged toward the inner wall of the casing 14 by a coil spring 33 which is inserted between the plunger 30 and the inner bottom shoulder 34 of the cylinder 22. The reference numeral 35 indicates a spring retainer disposed on the shoulder 34 at the bottom of the cylinder 22.

The plunger 30 is in sliding contact at a ring 36 made of an elastic material with the inner wall of the cylinder 22. According to the invention the contact length between the periphery of the plunger 30 and the inner wall of the cylinder 22 may be reduced to a very short length as compared with the diameter of the plunger 30. For example, the contact length in the axial direction of the plunger 30 at the ring 36 may be less than one tenth of the inner diameter of the cylinder 22. The ring 36 is also effective for preventing the liquid leakage between the plunger 30 and cylinder 22.

According to the invention hydrostatic pressure supporting means is provided for keeping the plunger 30 in a perfect pressure balance. Hydrostatic pressure supporting means comprises a centrally disposed recess 41 formed in the outer end face 31 of the plunger 30 and a port 42 formed in the plunger 30 communicating the recess 41 with the cylinder interior. The port 42 is preferably formed along the axis of the plunger 30. It should be noted that the central recess 41 is always concentrically disposed with respect to the axis of the cylinder 22.

Any rotation of the bearing block 17 is only allowed within a limited range which is defined by laterally extending pins 50 secured to the casing 14. The reference numeral 51 indicates recesses formed in the peripheral surface of the bearing block 17 for engagement with said pins 50, respectively. Any movement of the bearing block 17 in the direction of the axis of the shaft 11 is constrained by collars 52 inserted between the opposite ends of the block 17 and the bearings 12, 13, respectively.

As clearly shown in FIG. 2, no more than two pins 50 are engaged in their corresponding recesses 51 at a given time during operation. This feature is instrumental in achieving the aforementioned advantages.

The side wall body 14*a* of the casing 14 may comprise five separate pieces 14*aa* of a crescent-shaped section having a flat face 32 and five distance pieces 14*ab* between each adjoining two crescent pieces 14*aa*. The crescent pieces 14*aa* are secured by radial screws 55 to the front and rear end covers 14*b* and 14*c* and the distance pieces 14*ab* are secured by lateral screws 56 to the front and rear end covers 14*b* and 14*c* thereby to form a complete casing 14.

The front end cover 14*b* is further covered by an oil stop cover 61 having an oil seal 62.

Two ducts 63 and 64 extend along the motor shaft 11 parallel to its axis, these ducts communicating at one end each with one of the aforesaid arcuate groves 18 and 19 in the eccentric 15 and at the other end each with one of two annuli 65 and 66 formed adjacent one another in the motor shaft 11. A distributor sleeve 67 surrounds this end portion of the motor shaft. This sleeve 67 has a pair of radial port 68 and 69 which communicate the annuli 65 and 66, respectively. The reference numerals 70, 71 and 72 indicate seal rings for preventing liquid leakage between the distributor sleeve and the shaft 11. The shaft 11 is further provided with a drain 73 communicating the interior of the casing 14 through a port 74 to the liquid tank outside the casing so that any leakage liquid in the casing may be discharged therethrough.

Assuming the port 68 to be functioning as the inlet port, the inflowing oil flows along the duct 63 into the arcuate groove 18. The oil then flows through the port 23 into the cylinders A and B which are in condition of communication with the arcuate groove 18 (FIG. 2). On the other hand, the oil in the cylinder D and E which are in condition of communication with the arcuate groove 19 flows through the ports 27 of the cylinders D and E, the arcuate groove 19 and the duct 64 to the outlet port 69. The volume of each of the cylinders A and B is reduced while the volume of each of the cylinders D and E is expanded with the result that the shaft 11 is caused to rotate in the direction of the arrow X in FIG. 2. At the state as shown in FIG. 2, the cylinder C which is closed by the land 20 of the eccentric 15 is in condition of non-working.

Since the arrangement of the invention is symmetrical, it will be selfevident that if the inlet and outlet ports for working fluid are reversed the output shaft 11 will be rotated in the opposite direction.

The most important feature of the invention is the absence of parts which slide under pressure towards each other by a force proportional to working fluid pressure, which will now be described in detail hereinbelow.

Since the conventional hydraulic motors, in most cases, receive a moment or lateral pressure proportional to the fluid pressure acting between the plunger and the inner wall of the cylinder, it has presented various problems due to a large friction force in high pressure operation, particularly at the time of starting.

FIG. 3 shows the balance of forces exerted by hydraulic pressure acting on a plunger 30. If the spring force is neglected and the plunger diameter is Dp, then the force Fp tending to push up the plunger is as follows:

$$Fp = \frac{\pi}{4} Dp^2 P$$

where P is the hydraulic pressure in the cylinder.

On the other hand, as for the force Fp′ tending to push down the plunger 30 by the hydraulic pressure in the pressure recess 41 in the top face 31 of the plunger, if the effective diameter of the circular recess 41 is Dp′, the force Fp′ is given as follows:

$$Fp' = \frac{\pi}{4} (Dp')^2$$

Therefore, by suitably selecting Dp′, it becomes possible that Fp nearly equals Fp′. For the practical purpose, Dp′ is selected so that Fp′ is slightly less than Fp.

In FIG. 3, the reference numeral 80 indicates an annular recess which is formed concentrically with the circular recess 41 in the top face of the plunger 30. The provision of the annualr recess, per se, is known in the conventional hydrostatic pressure bearing.

The above mentioned substantially perfect balance of the plunger in its axial direction can only be obtained with the provision of a centrally disposed recess in the top face of the plunger. It will be understood that if the top face of the plunger is flat and the cooperating face in the inner wall of the casing has a pressure pocket for a hydrostatic pressure bearing, such perfect pressure balance as mentioned above can never be obtained because the pressure pocket is not always in central alignment with the axis of the plunger and the cylinder during the relative sliding operating between the top face of the plunger and the cooperating face in the inner wall of the casing.

In the case of the type in which output rotation is derived from the casing with the shaft 11 fixed, there is an upwardly directed centrifugal force due to the mass of the plunger, but this force, like the spring force, if of negligible degree as compared with the force exerted by the hydraulic pressure.

In order to ensure a perfect contact of the top face of the plunger with the cooperating face of the casting even if there is some machining error, it is highly desirable that the length of contact $l$ of the plunger with the cylinder be small as compared with its diameter, as shown.

Figure 4A:
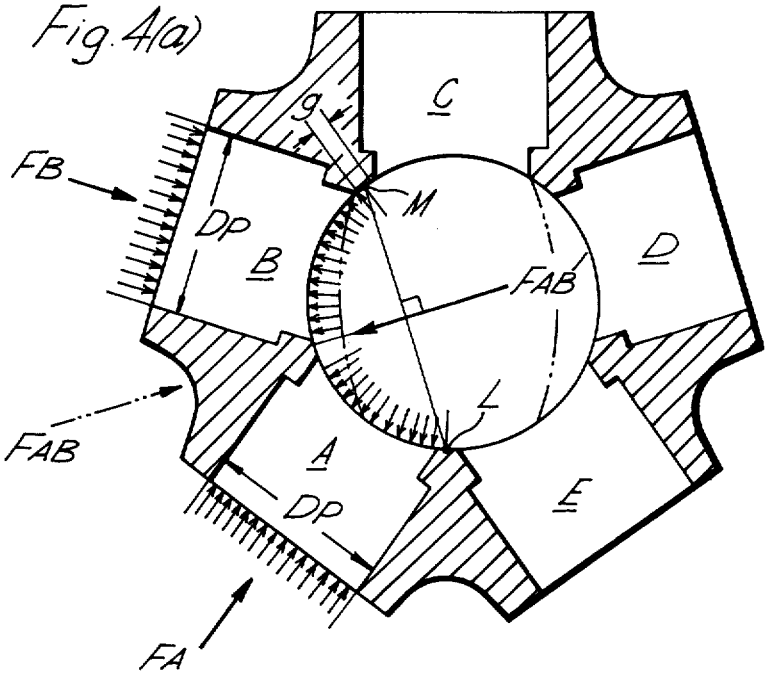
FIGS. 4 (*a*) and 4 (*b*) show views for explanation of the pressure balance on the bearing block of the motor illustrated in FIGS. 1 and 2.
Figure 4B:
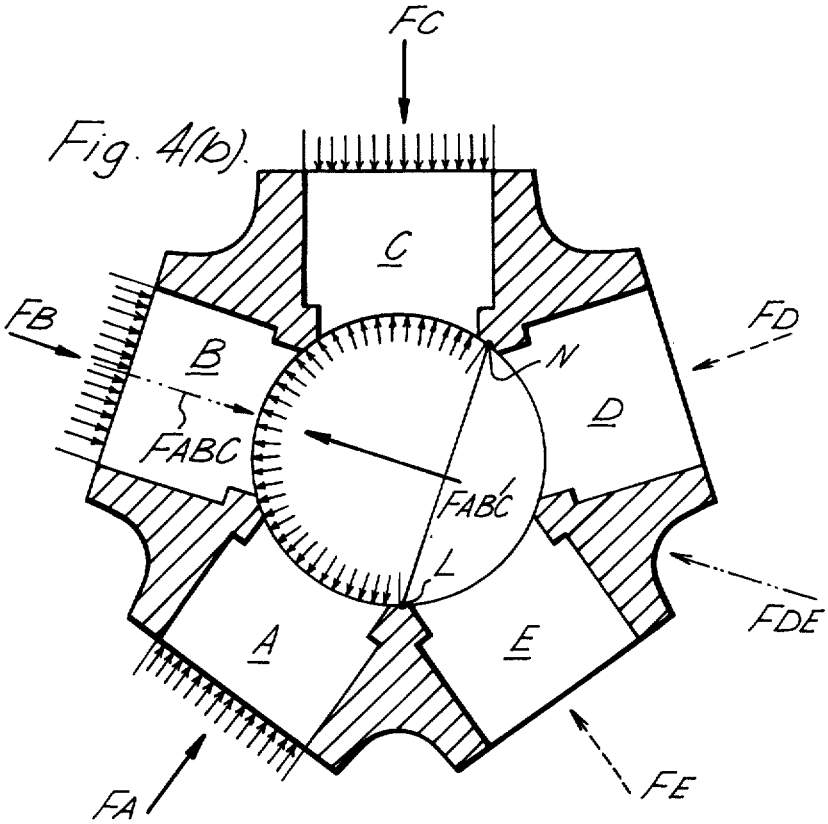

Next, reference will be made to the balance of forces exerted by the liquid acting on the cylinder block 17. FIG. 4(*a*) shows a liquid pressure acting on the two cylinders A and B, while FIG. 4(*b*) shows a liquid pressure being admitted into the cylinder C besides the cylinders A and B. Where there are five cylinders as in this embodiment, there are two cases, one in which two cylinders are subjected to high pressure, the other in which three cylinders are subjected to high pressure, these cases occurring alternately.

The hydraulic pressure externally pushing the block toward the center in the condition shown in FIG. 4(*a*) is represented by two vectors $F_A$ and $F_B$. These two vectors are of the same magnitude. Namely, $$F_A = F_B = F_P = \frac{\pi}{4} Dp^2 \cdot P$$

The angle between them is $2\pi/5$.

Therefore, the resultant vector $F_{AB}$ of the vectors $F_A$ and $F_B$ is on the bisector of the angle between $F_A$ and $F_B$, as shown. The magnitude thereof is as follows:

$$F_{AB} = 2 \cos \left(\frac{\pi}{5}\right) \cdot Fp = \frac{\pi}{2} \cos \left(\frac{\pi}{5}\right) Dp^2 \cdot P$$

As shown, let $F_{AB}'$ be the liquid pressure tending to push back the block outwardly from the inner surface of the central bore in the block forming the rotary sliding surface in contact with the eccentric portion of the output shaft.

As shown, when the hydraulic pressure is acting on the region of an arc LM (the smaller side) and if the effective width of the pressure region at right angles with the paper is called $b$, the magnitude of the vector $F_{AB}'$ is as follows:

$$F_{AB}' = a\,b\,p$$

where $a$ is the length of the chord LM. Further, the direction of the vector $F_{AB}'$ coincides with that of the perpendicular bisector of the chord LM. Since L and M are points in lands at the boundries between the cylinders E and A and between the cylinders B and C, respectively, if the width of the land $g$ is small enough, the line LM is at right angles with the direction of the resultant vector $F_{AB}$ of $F_A$ and $F_B$, as is apparent from the FIG. 4(*a*). Therefore, $F_{AB}'$ which lies on the perpendicular bisector of the line LM is opposite to $F_{AB}$.

Further, by selecting the width $b$ of the pressure region so that $$b = \frac{\pi}{2} \cos \left(\frac{\pi}{2}\right) Dp^2/a,$$

$$F_{AB}' = F_{AB}$$

Thus, statically it is possible to maintain a perfect hydraulic balance.

If the value of $b$ is selected in this manner, hydrostatic balance can also be maintained in the case where the hydraulic pressure acts on three cylinders as shown in FIG. 4(*b*). In this case, the hydraulic force externally pushing the block toward the center is represented by three vectors $F_A$, $F_B$ and $F_C$, as shown, and the direction of the resultant vector $F_{ABC}$ of these three vectors is the same as that of $F_B$, as shown. On the other hand, the hydraulic force tending to push back the block outwardly from the inner surfaces of the cylindrical bore is due to the hydraulic pressure acting on the region of the large arc LN, and if it is represented by a vector $F_{ABC}'$, it lies on the perpendicular bisector of the chord LN. Since L and M are points in lands at the boundaries between the cylinders E and A and between the cylinders C and D, respectively, if the widths of the lands are small enough, the line LM is at right angles with the resultant vector $F_{ABC}$ of $F_A$, $F_B$ and $F_C$, as is apparent from the Figure. Therefore, $F'_{ABC}$ is opposite to $F_{ABC}$.

Assuming that there are $F_D$ and $F_E$ and their resultant vector $F_{DE}$ as shown, the resultant vector of $F_{DE}$ and $F_{ABC}$ becomes equal to the resultant vector of all the vectors $F_A$, $F_B$, $F_C$, $F_D$ and $F_E$. Of course, they are balanced with each other to become zero, so that $F_{ABC}$ is equal in magnitude to $F_{DE}$. (But it is opposite in direction). Further, since $F_{DE}$ is equal in magnitude to $F_{AB}$, $$F_{ABC} = F_{DE} = F_{AB}$$

On the other hand, as is apparent from the FIGS. 4(*a*) and 4(*b*), $$\overline{LN} = \overline{LM} = a,$$

and, $$F_{ABC}' = \overline{LN} bP = a\,b\,P$$

therefore $$F_{ABC}' = F_{AB}' = F_{AB} = F_{ABC},$$

so that perfect balance can be maintained.

While the embodiment shown in FIG. 4 has been described as having five cylinders, generally where there are $2n + 1$ cylinders, there are two cases alternate with each other; in one case n cylinders are under high pressure and in the other $n + 1$ cylinders are under high pressure. It is possible to maintain hydraulic balance in these two cases simultaneously. This is the same as the embodiment comprising five cylinders.

Figure 5:
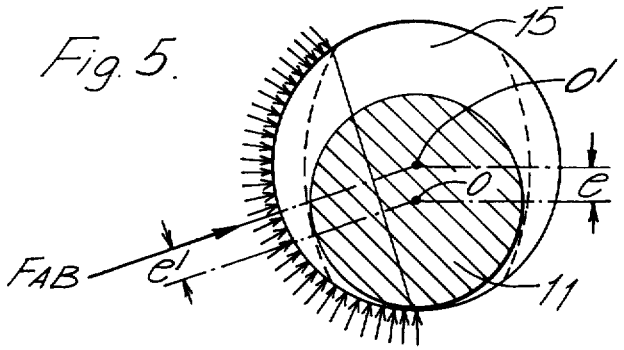
FIGS. 5 and 6 are explanatory views showing the principle of torque generation in a shaft and a casing of the motor illustrated in FIGS. 1 and 2, respectively.

FIG. 5 shows the principle of torque generation by the output shaft and corresponds to FIG. 4(*a*). Since the vector $F_{AB}$ representing the force due to the hydraulic pressure acting on the outer periphery of the eccentric of the output shaft has a torque arm $e'$ with respect to the center of rotation O of the shaft 11, there is generated an output torque of $F_{AB} \times e'$. In this case, the radial load $F_{AB}$ is supported by the pair of bearings 12, 13 (FIG. 1).

Figure 6:
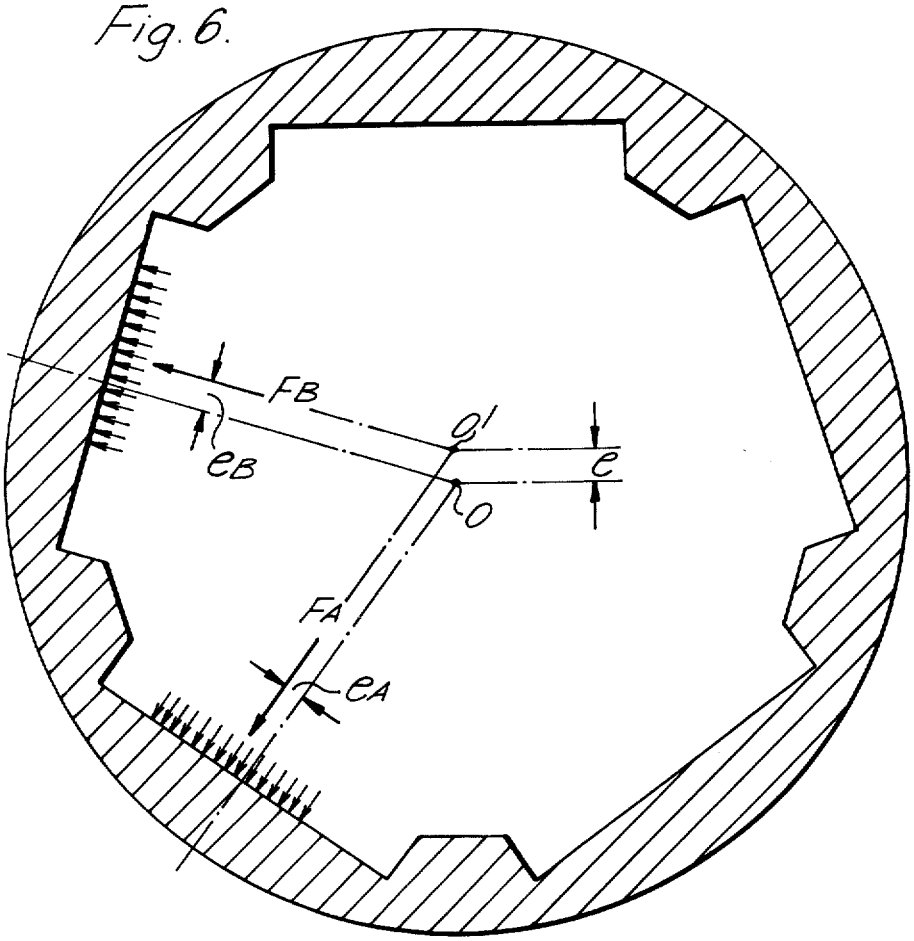

FIG. 6 is a view used for the explanation of a reaction torque to which the casing of the hydraulic motor is subjected, the condition of pressure action being the same as in the case of FIG. 4(*a*).

Since the vectors $F_A$ and $F_B$ representing the forces due to the hydraulic pressure act through the center O' of the eccentric, they are each eccentric by an amount of *e* with respect to the center O of the casing (the center of the output shaft). Since the vectors $F_A$ and $F_B$ have torque arms $e_A$ and $e_B$, respectively, with respect to the center O, there is a reaction torque which is equal to $$FA \times e_A + F_B \times e_B$$

acting on the casing. Since action and reaction are equal, this torque is equal in magnitude to the output torque $F_{AB} \times e'$ of the shaft.

If the clearance between the periphery of the eccentric and the cylindrical bore formed in the bearing block is not negligible, the problem will arise with respect to the pressure liquid leakage at the lower pressure side in the cylindrical bore in which the eccentric is fitted. Particularly if the lower pressure side of the motor has still an effective pressure, for example, as in the case where the lower pressure side of the motor is connected to the higher pressure side of another motor for series connection, the pressure liquid leakage will become a serious problem. On the other hand, if a heated liquid is suddenly supplied through the inlet duct formed in the shaft to the motor, the shaft may be prevented from rotation due to the so-called "thermal shock" which is caused by a difference in thermal expansion between the eccentric of the shaft and the bearing block.

Figure 8:
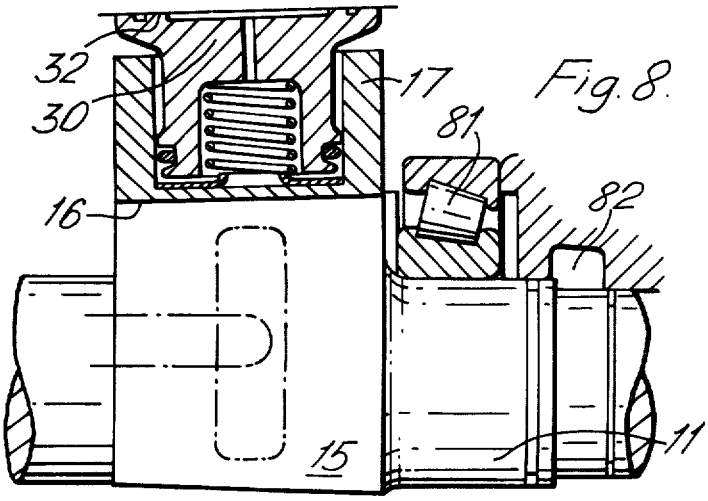
FIG. 8 is a fragmental view of another embodiment of the invention.

The above occasional disadvantages can be avoided by the utilization of an eccentric in the form of a cone. FIG. 8 illustrates another embodiment of the invention for this purpose. In FIG. 8, like numerals indicate similar parts to those indicated in FIGS. 1 and 2. In the embodiment illustrated in FIG. 8, the eccentric 15 of the shaft 11 is formed in a cone having a slight gradient generatrix. The bearing block 16 has a conical bore engageable with the conical eccentric 15 for a relative rotation therebetween. The flat face of abutment formed in the inner wall of the casing is extending in a plane parallel to the generatrix of the conical eccentric 15. Accordingly, the coaxis of the plunger 30 and the cylinder 22 extends in a direction perpendicular to the generatrix of the conical eccentric 15. Preferably, the bearing block is biased as by a spring (not shown) toward the larger diameter of the conical eccentric so that the conical bearing block may be engaged with the eccentric with the smallest possible clearance. Any thrust may be counteracted by providing a thrust bearing 81 and/or a liquid pressure chamber 82 which is formed around a journal portion of the shaft 11.

With the above arrangement, the degree of fitting between the eccentric portion and the bearing block can be improved, which, in turn, facilitates the machining of the eccentric portion and the inner surface of the bearing block.

The present invention may also be embodied in the form of double type, triple type, etc. hydraulic motors or pumps, in which case greater merits may be obtained. That is, two, three or more eccentric portions may be formed on a single output shaft and as many bearing blocks as are required are engaged thereto. In this case, a plurality of bearing blocks may be integrally formed. In such embodiment, the machining cost is reduced and yet it is possible to provide a motor which produces high torque and which can be used as a low speed pump to advantage as well.

Figure 7:
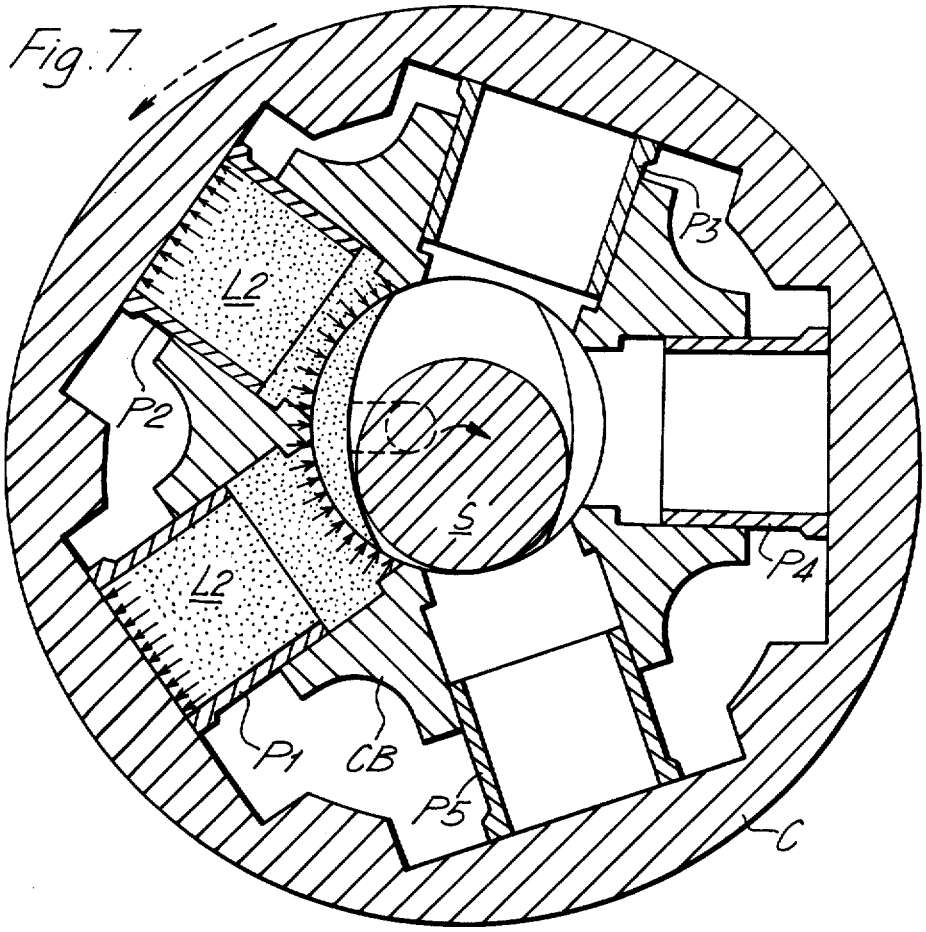
FIG. 7 is an explanatory view showing the principle of operation of the motor according to the invention.

The hydraulic motor of the invention is designed to operate in such a manner that, as shown in FIG. 7, a shaft S at the center and a casing C surrounding it exert turning moments on each other in an action-and-reaction fashion through radial high pressure liquid columns (in the case shown two liquid columns $L_1$ and $L_2$).

Therefore, the radially installed pistons $P_1 - P_5$ are no more than cylindrical seal members for holding pressure liquid columns so far as their essential function is concerned. Therefore, as already described in detail in the above, not only the plungers but also the bearing block are perfectly statically balanced, not taking part in the transmission of force through mechanical contact. The central shaft S is subjected to a turning moment in the direction of solid line arrow shown in FIG. 7 to have an output torque tending to rotate it in that direction, while the casing C is subjected to a turning moment in the direction of broken line arrow, so that it will have an output torque tending to rotate it in that direction if the central shaft is fixed.

As has been described so far, according to the present invention since the transmission of force by mechanical contact is not effected, various problems including wear and friction of main parts, particularly torque loss at the time of starting and slip stick during very-low speed operation can be solved and a highly efficient long-life hydraulic motor or pumps can be obtained.

While the embodiments described so far comprise five cylinders, the number of cylinders is not limited to five. Further, the mechanism for preventing the rotation of the bearing block has been described as comprising five pins and five cooperating recesses but it is, of course, possible to use various known mechanism for preventing such rotation. Further, by limiting the degree of freedom of the fitting between the pistons and cylinder block to some extent, such rotation-preventive mechanism can be dispensed with. Further, in the present embodiments, a type has been shown in which the casing is fixed and the shaft is rotated, but it is also possible to provide another type in which the shaft is fixed and the casing is rotated by one revolution to derive output, in which case the distributor becomes unnecessary since it is possible to introduce working liquid directly into the central shaft.

In the case where the apparatus illustrated in FIGS. 1 and 2 is used as a motor, the spring 33 may be omitted because a force urging the plunger 30 toward the casing side wall 14*a* is obtained by a pressure difference between the interior of the cylinder and the pressure recess 41 at the time of starting the operation. In this connection, the recess 41 must be communicated through a throttle port 42 to the interior of the cylinder 22.

The hydraulic motor illustrated in FIGS. 1 and 2 may also be operated for free wheeling. For this purpose, the spring 33 in each cylinder is omitted and a pressure liquid is introduced through the drain 73 into the casing 14 with both the two ports 68 and 69 being open to a low pressure (a tank). With this arrangement, even if a torque is given to the shaft 11 from the exterior, the motor can be rotated with a minimum possible drag torque. During such free wheeling operation like this, the plungers are all spaced from the inner wall of the casing and pressed toward the faces of the respective inner most positions in the cylinders.

As has been described in detail so far, since the present invention composes a hydraulic engine causing almost no wear and friction out of a few simple components, it is highly durable and inexpensive having many industrial merits.

What is claimed is:

1. In a hydraulic motor or pump comprising a casing, a shaft, means journalling said shaft in said casing, an eccentric on said shaft, a bearing block within said casing and about said eccentric and having a bore permitting relative rotation between said bearing block and said eccentric, a plurality of hydraulic cylinders formed and grouped in said bearing block radially about said eccentric in a common plane normal to the axis of said shaft, a plunger slidable in each of said cylinders, said plunger having an outer end face, flat faces of abutments formed in said casing at its internal surface for engagement with said outer end faces of said plungers, respectively, means urging said plunger in the direction of said face of abutment of said casing during the operation of said motor or pump, and said bearing block having a port communicating between its bore and the interior of each of said cylinders, pressure liquid being admitted to the cylinders in turn one after another during the operation of said motor or pump, the improvement comprising a centrally disposed recess formed in said outer end surface of each said plunger in alignment with the axis of said plunger, a port formed in said plunger communicating said recess with said cylinder interior, said centrally disposed recess having an area almost equal to that of the pressure bearing surface of said plunger, a shoulder on each of said plungers to engage the cylinder wall at a limited length, restraining means formed between said casing and said bearing block for limiting the range within which said bearing block is allowed to rotate with respect to said casing, said restraining means including a number of laterally extending pins affixed to said casing and a number of generally semicircular cooperating recesses formed in the peripheral surface of said bearing block, said number of said pins and recesses being equal to the number of said hydraulic cylinders, said pins being engageable by said recesses such that during operation no more than two pins are in physical contact with their corresponding recesses, and said bearing block being carried about said eccentric such that the radially directed hydraulic forces exerted by the liquid acting on said block are always balanced with the liquid pressures within said cylinders during the operation of said motor or pump.

2. A hydraulic motor or pump as defined in claim 1, in which said limited length of the engageable portion of said plunger is less than one tenth of the diameter of said plunger.

3. A hydraulic motor or pump as defined in claim 1, in which said casing is provided with a drain through which leakage liquid in the interior of said casing may be discharged to a tank outside of said casing and through which occassionally a liquid pressure may be supplied to the interior of said casing for an idle operation of said motor or pump.

4. A hydraulic motor or pump as defined in claim 1, in which the outer peripheral surface of said eccentric is formed in a cone, said bearing block having a central conical bore engageable with said conical outer peripheral surface of said eccentric for a relative rotation therebetween, and said flat faces of abutments formed in said casing are extending in planes parallel to the generatrix of said conical outer peripheral surface of said eccentric.

5. A hydraulic motor or pump as defined in claim 1 wherein the sectional area of each of said hydraulic cylinders and the effective pressure receiving area of the inner surface of said bore on which liquid pressure acts to urge said bearing block radially are correlatively dimensioned such that radially directed hydraulic forces exerted by said liquid acting on said bearing block are always balanced with liquuid pressures within said cylinders during operation of said motor or pump and each plunger is positioned in its corresponding cylinder with its central axis substantially aligned with that of said cylinder.

6. A hydraulic motor or pump as defined in claim 1 which further includes a distributor sleeve adjacent said casing and surrounding said shaft, said distributor sleeve being formed with two generally radially extending ports at different axial positions with respect to each other, and wherein said shaft is formed with:

two generally arcuate grooves on essentially opposite sides of said eccentric, two generally annular grooves on the portion of said shaft enclosed within said distribution sleeve, each of said annular grooves being in communication with one of said ports in said distribution sleeve, and two ducts formed generally central of said shaft, each of said ducts communicating one of said annular grooves with one of said arcuate grooves, such that one of said ports acts as an inlet port for the introduction of actuating fluid and the other port acts as an outlet port for said actuating fluid.

7. A hydraulic motor or pump as defined in claim 6 wherein said casing includes:

a number of generally crescent-shaped sections, each having an essentially flat inner surface adjacent the outer end face of one of said plungers, the number of said crescent-shaped sections being equal to the number of said cylinders;

an identical number of distance pieces, each of said distance pieces being affixed between adjacent crescent-shaped sections;

a front end cover; and a rear end cover adjacent said distribution sleeve, each of said covers affixed to said crescent-shaped members essentially perpendicular thereto for enclosing said cylinders.

* * * * *